US005172479A

United States Patent [19]

Keeton

[11] Patent Number: 5,172,479

[45] Date of Patent: Dec. 22, 1992

[54] PNEUMATIC SCISSORS

[76] Inventor: J. Herbert Keeton, c/o P.O. Box 296, 747 Meader St., Campbellsville, Ky. 42719

[21] Appl. No.: 757,630

[22] Filed: Sep. 11, 1991

Related U.S. Application Data

[63] Continuation-in-part of Ser. No. 701,075, May 16, 1991.

[51] Int. Cl.[5] ..... B26B 15/00

[52] U.S. Cl. ..... 30/228; 30/210

[58] Field of Search ..... 30/228, 216, 210, 223-225, 30/236, 330, 331, 180

[56] References Cited

U.S. PATENT DOCUMENTS 4,949,461 8/1990 van der Merwe et al. ..... 30/228

*Primary Examiner*—Douglas D. Watts

*Attorney, Agent, or Firm*—Nixon & Vanderhye

[57] ABSTRACT

A scissors action cutter is pneumatically actuated, by a pneumatic actuator that continuously effects reciprocation of a shaft as long as an actuating lever is depressed. The reciprocal shaft is in abutting engagement with, or connected to, an actuating extension of a movable scissors blade pivotal about an axis. The movable blade cooperates with a stationary substantially planar blade, which has a free end. The movable blade thickness is significantly greater than the stationary blade thickness, so that the movable blade does not deflect out of plane, and the stationary blade is deflected out of plane at its free end, biased toward a plane of movement of the movable blade. The blades are mounted on an elongated small diameter, lightweight, cylindrical casing dimensioned to be easily held in a human hand, and the pneumatic actuator is disposed within the casing. A lever operated valve is actuated by the user's hand, exteriorly of the casing, to effect cutting.

21 Claims, 3 Drawing Sheets

Fig. 1
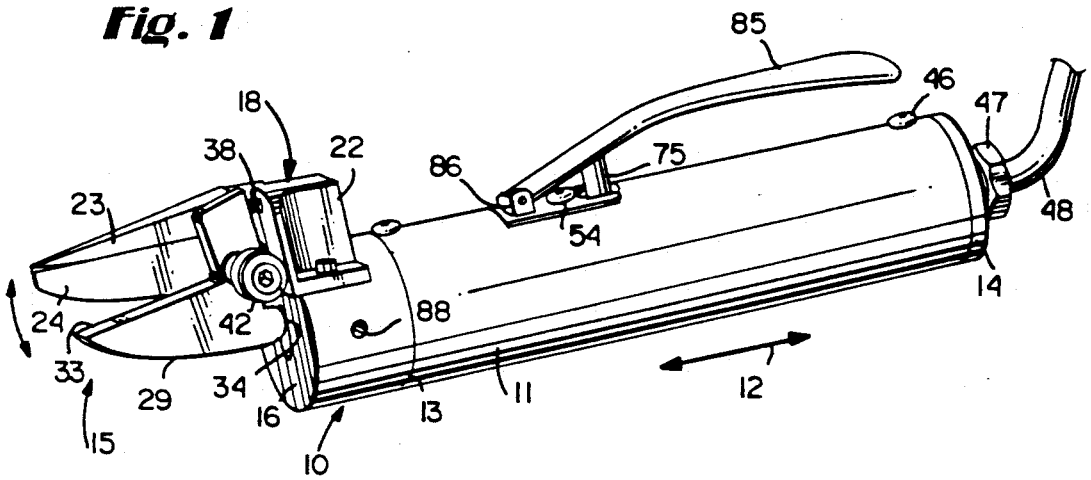
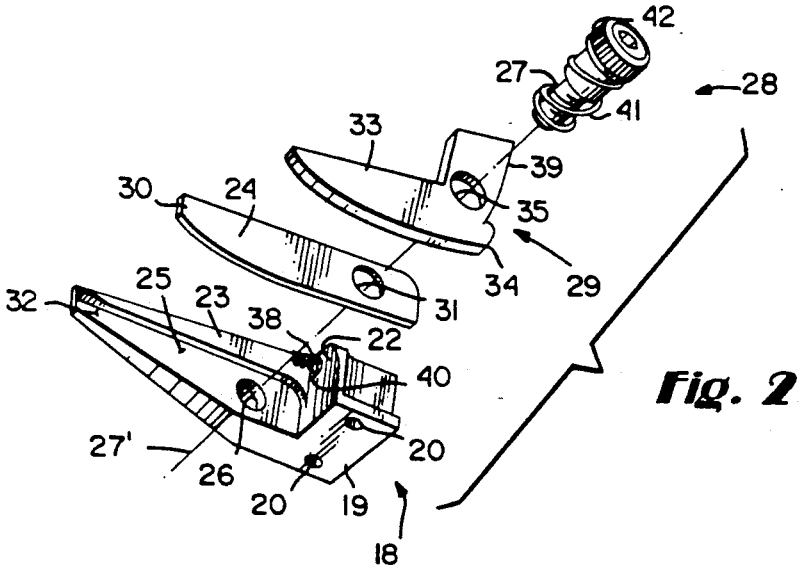
Fig. 2
Fig. 4
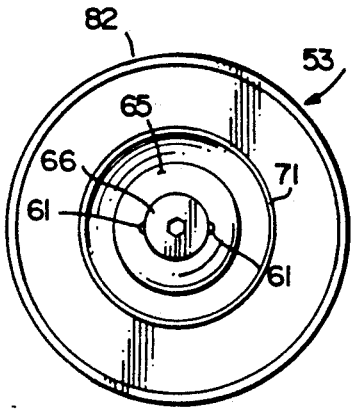

PNEUMATIC SCISSORS

CROSS REFERENCE TO RELATED APPLICATION

This application is a continuation in part of application Ser. No. 07/701,075 filed May 16, 1991, the disclosure of which is hereby incorporated by reference herein.

BACKGROUND AND SUMMARY OF THE INVENTION

It is known that a powered scissors type cutting action is an effective cutting action in the garment industry. However there have been a number of impediments to its optimum utilization. Quick wearing of the blades is one significant problem. Many powered cutters attempt to maintain the blades in perfect parallel planes, and the blades are typically of approximately the same thickness. According to the invention, an entirely different approach is taken, which will extend blade life, before replacement is necessary.

According to the present invention, the movable blade is made so that its thickness—or equivalent property leading to rigidity—is significantly greater than that of the stationary blade, so that the movable blade is not readily deflected out of plane, while a stationary blade is. The free end of the stationary blade—remote from the pivot axis for the movable blade—is mounted so that the free end thereof is deflected out of its normal plane, into the plane of movement of the movable blade. This deflection is accomplished either by a rigid element which engages the stationary blade and holds it in the desired position, or by an adjustment screw that engages the stationary blade adjacent its free end, and is movable in a dimension parallel to the pivotal axis of the movable blade.

Another significant problem that exists in the garment industry is tendinitis for human operators who work using scissors. Constant operation of a manual scissors causes significant adverse health effects in a number of people, making it highly desirable to substitute a powered scissor action cutter for the manual cutters. However, conventional prior art powered scissor cutters are two-three inches in diameter, and weigh two to three pounds, making them very unwieldy, so much so that many operators cannot effectively use them. Therefore, there is need for a powered scissors action cutter that is highly maneuverable, lightweight, and may be easily held in an operator's hand.

According to the present invention, a scissors action cutter is provided which achieves the above goals. The scissors action cutter according to the invention may be easily held in one hand by a female human operator and readily maneuvered, since the casing itself has a diameter of only about one inch (typically less than about one and one-half inches), and the cutter itself has a weight of less than about one pound, yet it is highly effective in performing a continuous cutting action.

According to the invention, a hand held powered readily maneuverable lightweight scissors action cutter is dimensioned and constructed to be held in a human hand and comprises the following components: An elongated casing, having a first end, and a second end opposite the first end in the dimension of elongation of the casing, and having a largest cross-sectional dimension of less than about one and one-half inches. A stationary cutting blade mounted on the casing and extending outwardly from the first end thereof, generally in the dimension of elongation, and having a free end most remote from the casing. A movable cutting blade having an actuating extension. Means for operatively mounting the movable cutting blade to the casing, and for movable movement about an axis generally perpendicular to the dimension of elongation of the casing, and for movement with respect to the stationary blade so that a scissors like cutting action is provided thereby. Powered means mounted within the casing, and having an actuating element thereof in operative engagement with the movable blade actuating extension. And, actuator means mounted on the casing engagable by a human hand, and mounted in association with the powered means so that movement of the actuator means into an actuating position effects movable movement of the movable blade to effect cutting action as long as the actuator means is maintained in an actuating position.

The powered means within the casing of the hand held cutter according to the invention is a pneumatic actuator which effects powered cutting action of the blades as long as the actuating element (typically a lever extending on top of the casing) is depressed. The pneumatic actuator per se is disclosed in the parent application Ser. No. 07/701,075 (particularly FIGS. 11 and 12 thereof). More particularly, the pneumatic actuator comprises: A body defining an interior cylindrical bore, having means defining an opening therein for introduction of gas under pressure. A piston, including the reciprocal shaft, and a piston face which is engaged by gas under pressure, the piston mounted in the cylinder for reciprocal movement therein. Means defining an opening in the piston face, including an interior bore parallel to the cylindrical bore. A stationary rod extending from the body into the piston interior bore. An O-ring having an outside diameter, and compressibility, such that the O-ring can sealingly engage the piston interior bore and prevent gas from passing therepast. Means for mounting the O-ring with respect to the piston so that O-ring moves with the piston, providing a gas-tight seal preventing gas from the cylindrical bore opening passing into the piston interior bore, a first distance, and after the O-ring and piston have moved together the first distance the piston continues to move while the O-ring does not so that there is relative movement therebetween and the seal between the O-ring and the piston interior bore is broken, and gas from the cylindrical bore opening may freely pass into the piston interior bore. And, vent means for venting gas passing into the piston interior bore. The means for mounting the O-ring comprises a rod fixed with respect to the body and extending into the piston interior bore substantially parallel to the cylindrical bore.

It is the primary object of the present invention to provide effective scissors action powered cutters. This and other objects of the invention will become clear from an inspection of the detailed description of the invention and from the appended claims.

BRIEF DESCRIPTION OF THE DRAWINGS

FIG. 1 is a perspective view of a hand held powered scissors action cutter according to the invention;

FIG. 2 is an exploded view of the blade components of the cutter of FIG. 1;

FIG. 4 is an end view of the middle interior component (valve body) of the structure of FIG. 3;

DETAILED DESCRIPTION OF THE DRAWINGS

Figure 3:
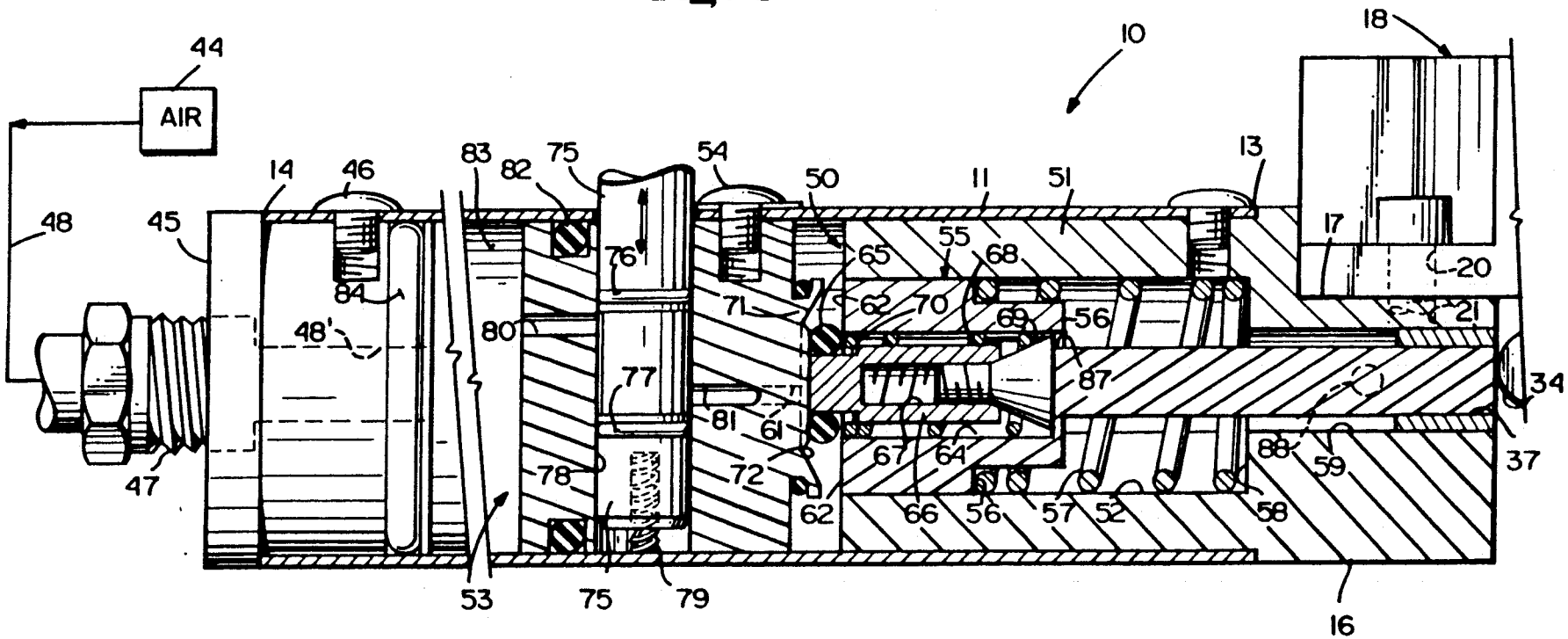
FIG. 3 is a side view, partly in cross-section and partly in elevation, of the cutter of FIG. 1.

A hand held powered readily maneuverable lightweight scissors action cutter, dimensioned and constructed to be easily held in a human female's hand, is illustrated generally by reference numeral 10 in FIGS. 1 and 3. The cutter 10 includes a casing 11, elongated in a dimension 12, and having a first end 13 and a second end 14. The casing 11 preferably is cylindrical, preferably having a circular cross-section, with a diameter of less than about one and one-half inches, and preferably a diameter of about one inch.

Mounted at the first end 13 of the cutter 10 is a scissors blade assembly 15. A cylindrical end cap 16 mounted at the first end 13 of the casing has a flattened top portion 17 (see FIG. 3) which receives a rigid blade mounting structure 18. The rigid blade mounting structure 18 includes a flat bottom portion 19 (see FIG. 2) having screw openings 20 therein through which screws pass into the interiorly threaded openings 21 (see FIG. 3) of the end cap 16. A stationary rigid support plate 22 extends upwardly from the face 19, and has an elongated (in the dimension 12) support structure 23 for a stationary blade 24, including the recessed portion 25, which has substantially the same shape as the stationary blade 24. An interiorly threaded opening 26 is provided in the extension 23 for receipt of an exteriorly threaded shaft 27 of a screw 28 which both mounts the movable blade 29 for pivotal movement about an axis 27' perpendicular to the dimension 12, and holds the components 18, 24, and 29 together.

The stationary blade 24 has a free end 30 which is most remote from the casing 11, and has a smooth bore 31 opposite the free end 30, which receives the screw shaft 27 therein. The stationary blade 24 has a relatively small thickness (e.g. about 1/32nd of an inch) so that it can be deflected out of its normal planar configuration. Specifically, the most remote tip portion 32 of the rigid support 18 for the stationary blade 24 extends toward the movable blade 29 and thereby biases/deflects the free end 30 of the stationary blade 24 so that it is slightly out of plane.

The movable blade 29 has a cutting portion 33, and an actuating extension 34 and has means defining a smooth bore hole 35 therein through which the screw shaft 27 passes. The movable blade 29 is pivotal about the axis 27' defined by the screw shaft 27 passing through opening 35. The movable blade 29 has a thickness significantly greater than the thickness of the stationary blade 24, e.g. a thickness of about 1/16th of an inch. Its thickness —or equivalent property—is great enough so that it will not be deflected out of plane by the same deflecting force which deflects the stationary blade 24 out of plane. Therefore the movable blade 29 will move in an essentially true (flat) plane as it pivots about the axis 27'.

The actuating extension 34 of the movable blade 29 typically is biased into contact with an actuator element, such as a reciprocal shaft 37. This is primarily accomplished by a coil spring 38 (see FIGS. 1 and 2) which engages the arm 39 of the movable blade 29 on the opposite side of the opening 35 from the actuating extension 34. The coil spring 38 is received within a recess 40 within the upwardly extending flange 22 of the stationary blade mounting structure 18. Another biasing action can be provided by the spring 41 surrounding the screw shaft 27, and engaging the bottom of the head 42, which will have a torsion action. In addition to the torsion action of the spring 41, it will also act as a compression spring biasing the movable blade 29 into contact with the stationary blade 24 at the axis for pivotal movement of the blade 29.

Connected to the casing 11 at the second end 14 thereof is a fitting for connecting the hollow interior of the casing 11 to a source of air under pressure, 44. As seen in FIGS. 1 and 3, an end cap 45 is connected by a screw 46 at the second end 14 of the casing 11, and has a conventional threaded air fitting 47 received therein, extending in a through-extending passageway 48', the passageway 48' elongated in the dimension of elongation 12. The fitting 47 is connected by a flexible hose 48 to the source of compressed air 44.

The mechanism for reciprocating the shaft 37, which is transformed into the pivotal, scissors like, cutting action of the movable blade 29 due to the abutting engagement between the actuating extension 34 of the movable blade 29 and the reciprocal shaft 37, is shown generally by reference numeral 50 in FIG. 3. This pneumatic linear motor 50 will effect continuous reciprocation of the shaft 37, and thus continuous scissors like cutting action of the blade assembly 15, as long as an actuator is depressed. This pneumatic linear motor is known per se from the parent application Ser. No. 07/701,075 filed May 16, 1991 (FIGS. 11 and 12 thereof). There are only minor differences between the motor 50 and that shown in the parent application, in order to accommodate the slightly different environment of the motor 50 from that shown in the parent application.

The pneumatic linear motor 50 (see FIG. 3) includes a body 51 defining a cylinder, including internal cylinder wall 52, with the open end of the cylinder defined by the wall 52 and casing 11 being closed off by the cylindrical insert 53 which is releasably held in place by screws 54. Mounted for reciprocal movement within the cylinder body 51, engaging the cylindrical wall 52, is a piston 55. The piston 55 has a shoulder 56 engaged by one end of a biasing coil spring 57. The opposite end of the coil spring 57 engages the closed end wall 58 of the body 51. The shaft 37, integral with piston 55, reciprocates through an opening 59 disposed in the wall 58.

Air under pressure is supplied to the interior 60 of the casing 11 through small openings 61 connected to element 53, the air being supplied by the hose 48 connected to the barbed fitting 47 and to the source of air under pressure 44. The air acts on the face 62 of the piston 55, to move it to the right as viewed in FIG. 3.

The piston 55 has an interior bore 63 including interior bore defining wall 64 therein, and an O-ring 65, of elastic material, is disposed so that it can fit within the bore 63, being slightly compressed against the bore wall 64 so that it provides a seal preventing the flow of air from source 44 into the bore 63 as long as the O-ring 65 engages the bore wall 64.

The O-ring 65 is mounted on a rod 66 which is stationary with respect to the element 53, and thus stationary with respect to body 51 since they are fixed to the casing 11. The rod 66 may be hollow, having a central bore 67. The escape of gas from inside the bore 63 to the outside of the cutter 10 is provided by the bore 87 which extends from the bore 63 into the chamber containing spring 57, and from there leaks to the atmosphere through bore 88. The bore 88 can extend through any portion of the casing 11, but typically vents through the left side (as illustrated in FIGS. 1 and 3) for left handed operators, and through the right side for right handed operators.

The O-ring 65 is normally biased in the direction toward the left as viewed in FIG. 3 by a light coil spring 68 which is disposed around the rod 66, and engages shoulder 69 at one end thereof, and the O-ring 65 at the other end thereof. The rod 66 has a shoulder 70 located a distance—compared to the length of travel of the piston 55—corresponding to the desired length of travel of the reciprocal shaft 37. The connection of the rod 66 to the element 53, and the connection of the air supply passages 61, are sealed by a large O-ring 71 and metal plate 72. The passages 61 are also formed in plate 72, interior of the O-ring 71.

Compressed air from source 44 is provided to the passages 61, and ultimately into the interior 60, through a valve 74 formed in the valve body element 53. The valve 74 includes a valve actuator shaft 75 having sealing O-rings 76, 77 sealingly engaging the internal bore 78 of the element 53. The bore 78 is perpendicular both to the dimension of elongation 12 of the casing 11, and to the axis 27' of pivotal movement. A coil spring 79 engages the bottom of the valve element 75 to bias it upwardly to a position in which the O-ring 77 prevents passage of air from the bore 80 into the bore 81. The bore 81 is connected to both of the passages 61. The element 53 is sealed with respect to the interior of the casing 11 by the O-ring 82. The volume 83 between the end cap 45 and the element 53 is filled with compressed air from the source 44, so that upon reciprocation of the valve stem 75 compressed air is immediately supplied to the chamber 60. The end cap 45 is sealed with respect to the interior of the casing 11 by an O-ring 84, defining the opposite end of the chamber 83 from O-ring 82.

The valve stem 75 can be moved downwardly, to move the O-ring 77 so that it no longer prevents passage of air into the bore 81, by any suitable actuator means, such as a push button connected to the top of the valve stem 75. A preferred embodiment of the actuator according to the invention, however, comprises lever arm 85 which is elongated in the dimension 12, and is pivotally connected at the leading end 86 to the casing 11 by a pivot pin or the like, so that it acts as a "trigger", and when the operator squeezes the lever 85 in the casing bottom 11, the lever 85 will move toward the casing 11 and the valve stem 75 will move downwardly.

Most of the major components—except for the elastomeric O-rings—are made of a suitable metal, such as steel. Lubricating coatings or sleeves (e.g., of polytetrafluoroethylene) may be provided if desired. The stationary blade mounting element 18 may be made of brass.

Because of the small size and simplicity of the components, the cutter 10 is truly a "miniature" type cutter that is not substantially heavier than hand scissors, typically having a weight of around a pound or less, while additionally being shaped and dimensioned to be easily held within a female human's hand. When the cutter 10 is used, tendinitis that may be associated with the use of hand operated scissors is avoided.

The exemplary cutting of cloth (e.g. for garments), or the like, utilizing the cutter 10 will now be described:

The operator holds the casing 11 in her hand, with the lever 85 engaging the palm of her hand, adjacent the base of the thumb. The cutter blades point away from the operator. She then moves the space between the blades 24, 29 so that the edge of the piece of fabric to be cut is received therebetween, and then exerts a slight squeeze to move the lever 85 toward the casing 11. This squeeze moves the valve stem 75 downwardly slightly so that the O-ring 77 does not block the bore 81 (see FIG. 3). When the bore 81 is not blocked, air under pressure from source 44, through fitting 47 in end cap 45, moves into interior pressurized chamber 83, passes through bore 80, around the narrow central portion of the valve stem 75 between the O-ring 76, 77, through the bore 81, and through the passageway 61 into the chamber 60. The compressed air in chamber 60 engages the face 62 of the piston 55, and the face of the O-ring 65 which is received within the bore 63. This causes the piston 55 to reciprocate to the right as viewed in FIG. 3 (downward into the left as viewed in FIG. 1), so that the shaft 37—which is in abutting engagement with the actuating extension 34 of the movable blade 29—will push the actuating extension 34 to the right as viewed in FIG. 3. This action is translated into pivotal action of the blade 29 about the axis defined by the axis 27', so that the cutting portion 33 of the movable blade 29 moves closer along its entire length to the stationary blade 24, effecting a scissors like cutting action which cuts the cloth that was between the blades 24, 29.

The end of the stroke of piston 55 is reached when the O-ring 65—moving right with the piston 55 in FIG. 3—engages the shoulder 70 on stationary rod 66. When it engages the shoulder 70 it can no longer move easily to the right, but the piston 55 can, and since the piston face 62 has a larger area on which the pressure from source 44 acts than the O-ring 65, the piston 55 will continue to move to the right so that there is relative movement between the piston 55 and the O-ring 65.

The relative movement between the piston 55 and the O-ring 65 eventually breaks the seal between the O-ring 65 and the bore 63. When the seal is broken, the air from source 44 no longer acts to push the piston 55 to the right, but rather passes through bore 87, and then through bore 88, to be vented to the environment.

Once the pressure pulse from the source 44 is terminated, the springs 57 and 68 will return the piston 55 and O-ring 65, respectively, to their initial positions so that they will be ready for another actuating sequence. Reciprocation back and forth of the piston 55, and thus the reciprocal shaft 37, and consequent scissors cutting action of the blades 24, 29 (movable blade 29 being returned to a non-cutting position by the coil spring 38, and perhaps a torsion action from the spring 41) will continue as long as the operator squeezes the trigger 85. As soon as she lets up on the trigger 85, however, the spring 79 moves the valve stem 75 upwardly, and the O-ring 77 closes off the passage 81, so that air is no longer supplied to the chamber 60, and the powered action of the blades 15 ceases.

Because of the construction of the relatively thin stationary blade 24, and its bias out of plane, into the planar path of movement of the movable, non-deflectable, blade 29, cutting elements 15 can be used, without replacement, for a longer period than with conventional scissors blades for powered cutters.

Figure 5:
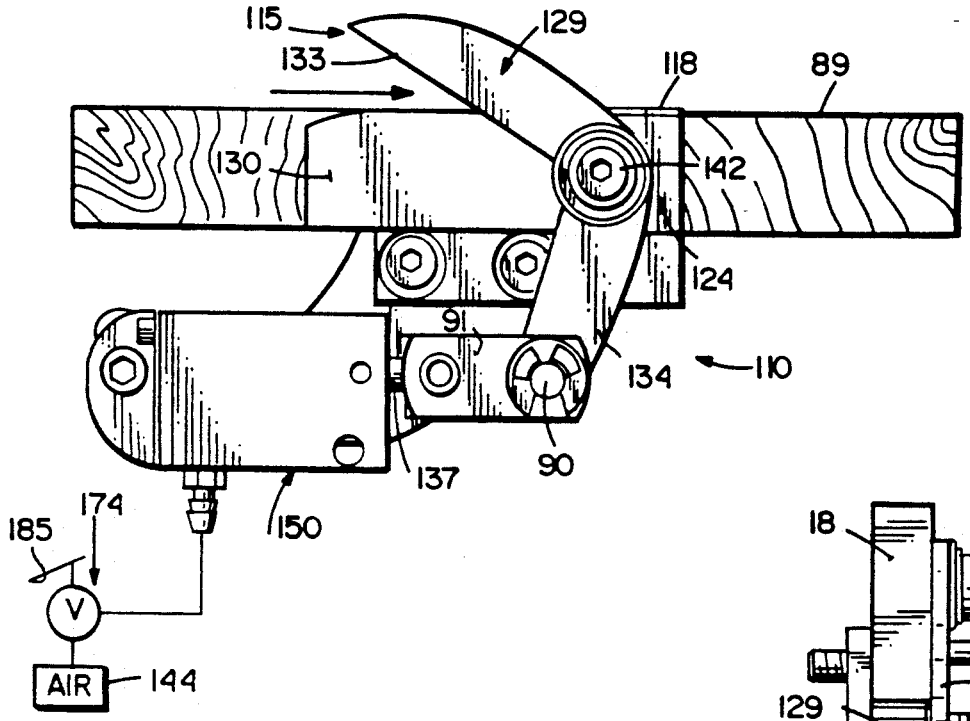
FIG. 5 is a side view of a second form of powered scissor action cutter according to the invention.
Figure 6:
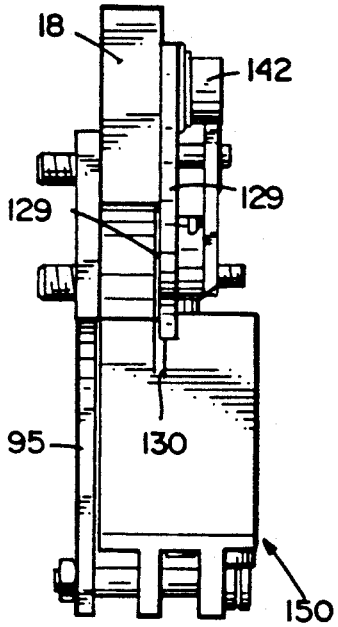
FIG. 6 is a top plan view of the cutter of FIG. 5.
Figure 7:
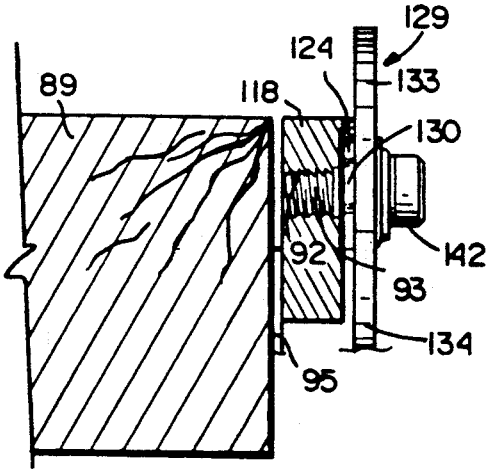
FIG. 7 is a detail end view of the blade portions of the cutter of FIG. 5.

Another embodiment of an exemplary powered cutter with scissors like cutting blade, according to the invention is illustrated in FIGS. 5 through 7. In this embodiment all structures comparable to those in the FIGS. 1 through 4 embodiment are illustrated by the same reference numeral only preceded by a "1".

In this embodiment, the major distinctions compared with the FIGS. 1 through 4 embodiment are the exact nature and construction of the movable blade, the manner in which the stationary blade is deflected, and use. This cutter 110 is not used as a hand held cutter, but rather is mounted stationarily under a table 89 so that cloth may move into the space between the cutting portion 133 of the movable blade 129, and the stationary blade 124.

The actuating extension 134 for the movable blade 129 is a lever arm, which is pivotally connected at 90 to a connection 91 reciprocal with the linearly reciprocal shaft 37, powered by the pneumatic motor 150. The pneumatic motor 150 is essentially identical to that illustrated in parent, co-pending application Ser. No. 07/701,075, and will not be illustrated or described.

The stationary blade 124 is mounted on support 118. At the most remote portion of the support 118 from the pivot point defined in part by the screw associated with screw head 142, an interiorly threaded bore 92 (see FIG. 7) is provided, with an exteriorly threaded screw 91 disposed therein. The bore 92, and the path of movement of the screw 93 within the bore 94, is perpendicular to the plane of the stationary blade 124, and parallel to the pivot axis (through screw head 42) of the movable blade 129. Thus by adjusting the screw 93, the degree of deflection of the free end 130 of the blade 124 can be controlled. The further the screw 93 moves to the right in FIG. 7, the greater the deflection. Thus the blade 124 can be adjusted for wear.

The entire mechanism 110 is mounted by a mounting plate 95 or the like to the table 89 so that the cutting elements 115 have the position illustrated in FIG. 5. By pressing down on the foot pedal 185, the valve 174 can be controlled to supply air from compressed air source 144 to the pneumatic motor 150, reciprocation of the linear shaft 137 being translated into pivotal movement of the blade 129, and thus scissors like cutting action of cloth fed to the cutting elements 115.

It will thus been seen that according to the present invention an effective yet simple powered scissors like cutting device has been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A scissors action cutter, comprising:

a stationary blade;

a movable blade, movable about an axis;

an actuating extension of said movable blade;

means for mounting said movable blade with respect to said stationary blade so that upon application of linear force to said actuating extension of said movable blade, said blade pivots about said axis to move with respect to said stationary blade in a scissors type cutting action, moving in a plane perpendicular to said axis;

a pneumatic actuator having a reciprocal shaft in engagement with said actuating extension of said blade; and said pneumatic actuator comprising:

a body defining an interior cylindrical bore, having means defining an opening therein for introduction of gas under pressure;

a piston, including said reciprocal shaft, and a piston face which is engaged by gas under pressure, said piston mounted in said cylinder for reciprocal movement therein;

means defining an opening in said piston face, including an interior bore parallel to said cylindrical bore;

a stationary rod extending from said body into said piston interior bore;

an O-ring having an outside diameter, and compressibility, such that said O-ring can sealingly engage said piston interior bore and prevent gas from passing therepast;

means for mounting said O-ring with respect to said piston so that said O-ring moves with said piston, providing a gas-tight seal preventing gas from said cylindrical bore opening passing into said piston interior bore, a first distance, and after said O-ring and piston have moved together said first distance said piston continues to move while said O-ring does not so that there is relative movement therebetween and the seal between said O-ring and said piston interior bore is broken, and gas from said cylindrical bore opening may freely pass into said piston interior bore; and vent means for venting gas passing into said piston interior bore.

2. A cutter as recited in claim 1 wherein said stationary blade is substantially planar, and has a free end and a first thickness; and wherein said movable blade has a second thickness significantly greater than said first thickness so that said movable blade does not deflect as easily as said stationary blade; and means for deflecting said stationary blade out of plane so that said free end thereof is biased toward said plane of movement of said movable blade.

3. A cutter as recited in claim 2 wherein said deflecting means comprises a rigid mounting element to which said stationary blade is attached, and shaped so as to permanently supply the bias.

4. A cutter as recited in claim 2 wherein said deflecting means comprises a rigid element to which said stationary blade is attached, and a screw movable, in a direction parallel to said movable axis with respect to said rigid element in engagement with said stationary blade adjacent said free end thereof, to adjustably deflect said stationary blade.

5. A cutter as recited in claim 3 further comprising spring means for biasing said movable blade about said axis so that said actuating extension thereof is biased into engagement with said reciprocal shaft.

6. A cutter as recited in claim 5 wherein said reciprocal shaft and said actuating extension make abutting contact with each other, not being affixed to each other; and further comprising spring means for biasing said movable blade into contact with said stationary blade at said axis.

7. A cutter as recited in claim 4 wherein said actuating extension of said movable blade is a lever arm, and wherein said reciprocal shaft is movably connected thereto.

8. A cutter as recited in claim 1 further comprising an elongated casing adapted to be held by a human hand, and containing said pneumatic actuator; a valve for valving air under pressure to be supplied to said pneumatic actuator mounted in said casing; and an actuator for actuation of said valve by a human hand associated with said casing; said stationary and movable blades being mounted on said casing, and said pneumatic actuator mounted within said casing with said reciprocal shaft extending into operative association with said movable blade actuating extension.

9. A cutter as recited in claim 8 wherein said blades extend outwardly from said casing at a first end thereof, said free end of said stationary blade being remote from said casing, and said actuating extension of said movable blade being adjacent said casing; and means for connecting said casing to a pneumatic hose extending outwardly from said casing at a second end thereof, opposite said first end.

10. A cutter as recited in claim 9 wherein said casing is cylindrical, having a circular cross-section with an external diameter of less than about one and one-half inches.

11. An actuator as recited in claim 1 wherein said means for mounting said O-ring comprises a rod fixed with respect to said body and extending into said piston interior bore, substantially parallel to said cylindrical bore.

12. An actuator as recited in claim 1 further comprising spring means for biasing said piston in a direction opposite to the direction of movement thereof in response to gas under pressure being introduced into said cylinder.

13. A cutter as recited in claim 10 wherein said valve actuator comprises an elongated lever, elongated generally in the dimension of elongation of said casing.

14. A hand held powered readily maneuverable, lightweight scissors-action cutter, dimensioned and constructed to be held in a human hand, and comprising:

an elongated casing, having a first end, and a second end opposite said first end in the dimension of elongation of said casing, and having a largest cross-sectional dimension of less than about one and one-half inches;

a stationary substantially planar cutting blade mounted on said casing and extending outwardly from said first end thereof, generally in said dimension of elongation, and having a free end most remote from said casing, and a first thickness;

a movable cutting blade having an actuating extension and having a second thickness significantly greater than said first thickness so that said movable blade does not deflect as easily as said stationary blade;

means for operatively mounting said movable cutting blade to said casing, and for movable movement about an axis generally perpendicular to the dimension of elongation of said casing, and for movement with respect to said stationary blade so that a scissors like cutting action is provided thereby;

powered means mounted within said casing, and having an actuating element thereof in operative engagement with said movable blade actuating extension;

actuator means mounted on said casing engageable by a human hand, and mounted in association with said powered means so that movement of said actuator means into an actuating position effects movable movement of said movable blade to effect cutting action as long as said actuator means is maintained in an actuating position; and means for deflecting said stationary blade out of plane so that said free end thereof is biased toward said plane of movement of said movable blade.

15. A cutter as recited in claim 14 wherein said deflecting means comprises a rigid mounting element to which said stationary blade is attached, and shaped so as to permanently supply the bias.

16. A cutter as recited in claim 15 further comprising spring means for biasing said movable blade about said axis so that said actuating extension thereof is biased into engagement with said powered means actuating element.

17. A cutter as recited in claim 14 wherein said powered means comprises a pneumatic linear reciprocating motor, and wherein said actuator means includes a lever operated pneumatic valve.

18. A scissors action cutter, comprising:

a stationary blade;

a movable blade, movable about an axis;

an actuating extension of said movable blade;

means for mounting said movable blade with respect to said stationary blade so that upon application of linear force to said actuating extension of said movable blade, said blade pivots about said axis to move with respect to said stationary blade in a scissors type cutting action, moving in a plane perpendicular to said axis;

said stationary blade being substantially planar, and having a free end and a first thickness;

said movable blade having a second thickness significantly greater than said first thickness so that said movable blade does not deflect as easily as said stationary blade; means for deflecting said stationary blade out of plane so that said free end thereof is biased toward said plane of movement of said movable blade; and an actuator having a reciprocal shaft in engagement with said actuating extension of said movable blade for powering scissors like cutting action of said blades.

19. A cutter as recited in claim 18 wherein said deflecting means comprises a rigid mounting element to which said stationary blade is attached, and shaped so as to permanently supply the basis.

20. A cutter as recited in claim 18 wherein said deflecting means comprises a rigid element to which said stationary blade is attached, and a screw movable, in a direction parallel to said movable axis with respect to said rigid element in engagement with said stationary blade adjacent said free end thereof, to adjustably deflect said stationary blade.

21. A cutter as recited in claim 19 further comprising spring means for biasing said movable blade about said axis so that said actuating extension thereof is biased into engagement with said reciprocal shaft.

* * * * *